US006691924B1

(12) United States Patent
Vestergaard et al.

(10) Patent No.: US 6,691,924 B1
(45) Date of Patent: Feb. 17, 2004

(54) EXPANSION VALVE HAVING AN INTERNAL BYPASS

(75) Inventors: Anders Vestergaard, Sydals (DK); Mogens Hørslev Rasmussen, San Pedro Garza Garcia (MX); Torben Funder-Kristensen, Sønderborg (DK); Hans Kurt Petersen, Kolding (DK)

(73) Assignee: Danfoss A/S, Nordborg (DK)

( * ) Notice: Subject to any disclaimer, the term of this patent is extended or adjusted under 35 U.S.C. 154(b) by 0 days.

(21) Appl. No.: 10/284,129

(22) Filed: Oct. 30, 2002

(51) Int. Cl.[7] ..... F25B 41/04
(52) U.S. Cl. ..... 236/92 B; 251/368
(58) Field of Search ..... 62/225; 236/92 B; 251/368

(56) References Cited

U.S. PATENT DOCUMENTS 4,372,486 A * 2/1983 Tomioka et al. ..... 236/92 B
5,251,459 A 10/1993 Grass et al.
6,354,510 B1 * 3/2002 Petersen ..... 236/92 B

* cited by examiner

*Primary Examiner*—William E. Tapolcai
(74) *Attorney, Agent, or Firm*—McCormick, Paulding & Huber LLP

(57) ABSTRACT

In an expansion valve a valve body combines an inlet and outlet in an orifice in fluid communication therewith. A closure is positioned in the valve body and is movable between an opened and closed position to allow or prevent fluid to flow through the orifice from the inlet to the outlet. The valve body defines a bypass flow path which is in fluid communication with the outlet and inlet to allow fluid to flow from the outlet to the inlet, a bypass closure positioned in the bypass flow path is movable between an opened position and a closed position so that when said closures in said closed position fluid flowing from said outlet towards an inlet causes a bypass closure to move toward said opened position allowing fluid to flow on a reverse direction from the outlet to the inlet. When the closure moves toward the opened position fluid pressure maintains the bypass closure in the dosed position allowing fluid to flow from the inlet to the outlet. The bypass closure is free floating within the valve body.

15 Claims, 5 Drawing Sheets

EXPANSION VALVE HAVING AN INTERNAL BYPASS

CROSS REFERENCE TO RELATED PATENTS

The invention disclosed herein are related to the invention recited in U.S. Pat. No. 6,354,510 entitled "Expansion Valve Housing", to Petersen, filed on Jan. 12, 2001, issued on Mar. 12, 2002 and assigned to the assignee of the present invention. U.S. Pat. No. 6,354,510 is incorporated by reference herein, in its entirety.

FIELD OF THE INVENTION

The present invention is generally related to expansion valves and more particularly to thermal expansion valves where the direction of fluid flow therethrough is reversible.

BACKGROUND OF THE INVENTION

Thermal expansion valves are generally used in systems employing heat pumps. In a heat pump system refrigerant flow is typically reversible. In this manner, the heat pump can be utilized to provide heating in cold weather and cooling in warm weather. To accomplish this, these systems generally employ two heat exchangers commonly referred to as coils. The coils used are an indoor coil and an outdoor coil each of which depending on whether the heat pump is operating to provide cooling or heating, can function as either a condenser or an evaporator. To facilitate proper operation of the heat pump system each of the coils typically has a thermal expansion valve coupled thereto.

Generally, when operating in a cooling mode, a compressor in the heat pump system forces refrigerant to a reversing valve. The refrigerant flows from the reversing valve to the outdoor coil which acts as the condenser. The refrigerant then flows from the outdoor coil through an expansion valve to the indoor coil which acts as the evaporator.

Typically, thermal expansion valves have a relatively small expansion orifice through which the refrigerant must flow in order to enter the cooling coil. As such, thermal expansion valves have historically been single direction. In reverse flow situations, an attempt to force refrigerant through the expansion orifice would unduly restrict flow. Accordingly, prior art heat pump systems were provided with an external bypass line that incorporated a check valve. In reverse flow situations, the refrigerant would flow through the bypass line and the check valve, which allowed fluid to pass therethrough in only one direction.

The separate check valve and bypass line often required field installation and multiple plumbing joints, thereby increasing installation expense, as well as maintenance costs. In addition, the potential for leaks also increased due to the added piping involved to connect the bypass line and the check valve to the heat pump.

In an effort to obviate the problems associated with external bypass lines and check valves, expansion valves incorporating internal check valves have been manufactured. However, these internal check valves typically employ multiple components including spring-loaded balls or plungers. Some known check valves have employed flapper valves. A flapper valve is typically gravity dependent and must be positioned in the proper orientation. Usually if mounted in an upright or sideways position, fluid pressure is required to maintain the flapper in a closed position. When mounted upright, gravity acts against the fluid pressure to keep the valve open. Therefore, if the heat pump is operated under low pressure, there is the potential for more pressure acting on the valve pushing it open, thereby making it impossible to maintain the valve in a dosed position. Because the check valve cannot be maintained in a dosed position, it becomes difficult to control expansion of the refrigerant through the valve.

Another difficulty occurs when the above-described valve is under high pressure. In this situation, there is a time lag between the start of high-pressure flow through the expansion valve and the closing of the flapper valve. During this time period the valve remains open and refrigerant can flow through the bypass line making the expansion valve difficult to control.

In valves wherein the check valve incorporates a spring-loaded ball positioned in a bore machined into a valve body, machining the bore can be difficult. Since the valve body is small and of a shape that does not easily render itself to precise positioning, complex fixtures are required which increase manufacturing time and cost. In addition, assembly of the components of the check valve adds to the overall complexity of the valve assembly. This further exacerbates the problems of increased manufacturing time and cost.

Based on the foregoing, it is the general object of the present invention to provide an expansion valve that improves upon or overcomes the problems and drawbacks associated with prior art expansion valves.

SUMMARY OF THE INVENTION

The present invention is directed in one aspect to an expansion valve that includes a valve body having an inlet and an outlet. An expansion orifice is defined by the valve body and is in fluid communication with the inlet and the outlet. A closure is positioned in the valve body and is movable between an opened and a closed position. When in the open position, the closure allows fluid to pass through the orifice from the inlet to the outlet. When in the closed position, of the closure blocks the orifice thereby preventing fluid from flowing between the inlet and the outlet.

The valve body also defines a bypass flow path that is in fluid communication with the outlet and the inlet. A bypass closure is positioned in a free floating manner in the bypass flow path and is also movable between an opened and a closed position. When the closure is in the closed position, and the flow of fluid is through the outlet, towards the inlet, commonly referred to by those skilled in the pertinent art to which the invention pertains as "reverse flow", pressure exerted by the flowing fluid against the bypass closure causes it to move from its closed position towards the open position. This allows fluid to pass from the outlet to the inlet. Conversely, when the closure moves from the closed position toward the open position, fluid flows from the inlet, through the expansion orifice, to the outlet. In this situation, fluid pressure is exerted against a rear surface of the bypass closure, thereby causing the bypass closure to be held in the closed position. Accordingly, fluid pressure, depending on the direction of flow is exerted against generally opposite sides of the bypass closure, thereby maintaining it in the closed or the open position.

To facilitate repeatable movement of the bypass closure, means are provided that define a guide path for bypass the closure. The bypass closure includes an extension protruding therefrom that is slidably received in the guide path. During operation, the extension travels within the guide path as the bypass closure moves generally rectilinearly between the open and the closed positions.

In the preferred embodiment of the present invention, a bypass cover is coupled to the valve body and defines, at least in part, the above-described guide path. Preferably, the guide path is in the form of a bore extending partway through the bypass cover. It is also preferable that the bypass cover be threadably attachable to the valve body.

The present invention also resides in the bypass closure being configured so as to prevent fluid, usually in the form of refrigerant, from being trapped in the guide path as the bypass closure moves between the open and the closed positions. To accomplish this the extension includes at least one radially projecting lobe, and preferably a plurality of such lobes formed so that the outermost edges thereof circumscribe a shape substantially equal to the cross-sectional shape of the guide path. In this manner, gaps between successive lobes allow fluid to escape from the guide path during movement of the bypass closure.

In most applications, the fluid passing through the expansion valve of the present invention will be refrigerant having a first density when in liquid form. It is preferable that the bypass closure be formed from a material defining a second density substantially equal to the first density. By using such a material, and since the bypass closure is nearly completely surrounded by refrigerant, the forces of gravity are neutralized by buoyancy. As such, the forces required to move the free floating bypass closure will only have to be of a magnitude sufficient to overcome any friction forces present. Therefore, the expansion valve can be oriented in any manner as the bypass closure is approximately completely surrounded by refrigerant when in the closed position.

An advantage of the present invention is that by employing a bypass closure configured as described above any refrigerant trapped in the guide path is easily displaced and does not become trapped behind the bypass closure thereby causing potential valve malfunctions.

Another advantage is that by employing a bypass cover that is threadedly mounted to the valve body and defines the guide path, difficult machining and fixturing of the valve body to form the guide path can be avoided.

Yet another advantage of the present invention is that by employing a bypass closure having substantially the same density as the liquid refrigerant, the valve can be positioned in any orientation without effecting its operation.

DETAILED DESCRIPTION OF THE PREFERRED EMBODIMENTS OF THE INVENTION

Figure 1:
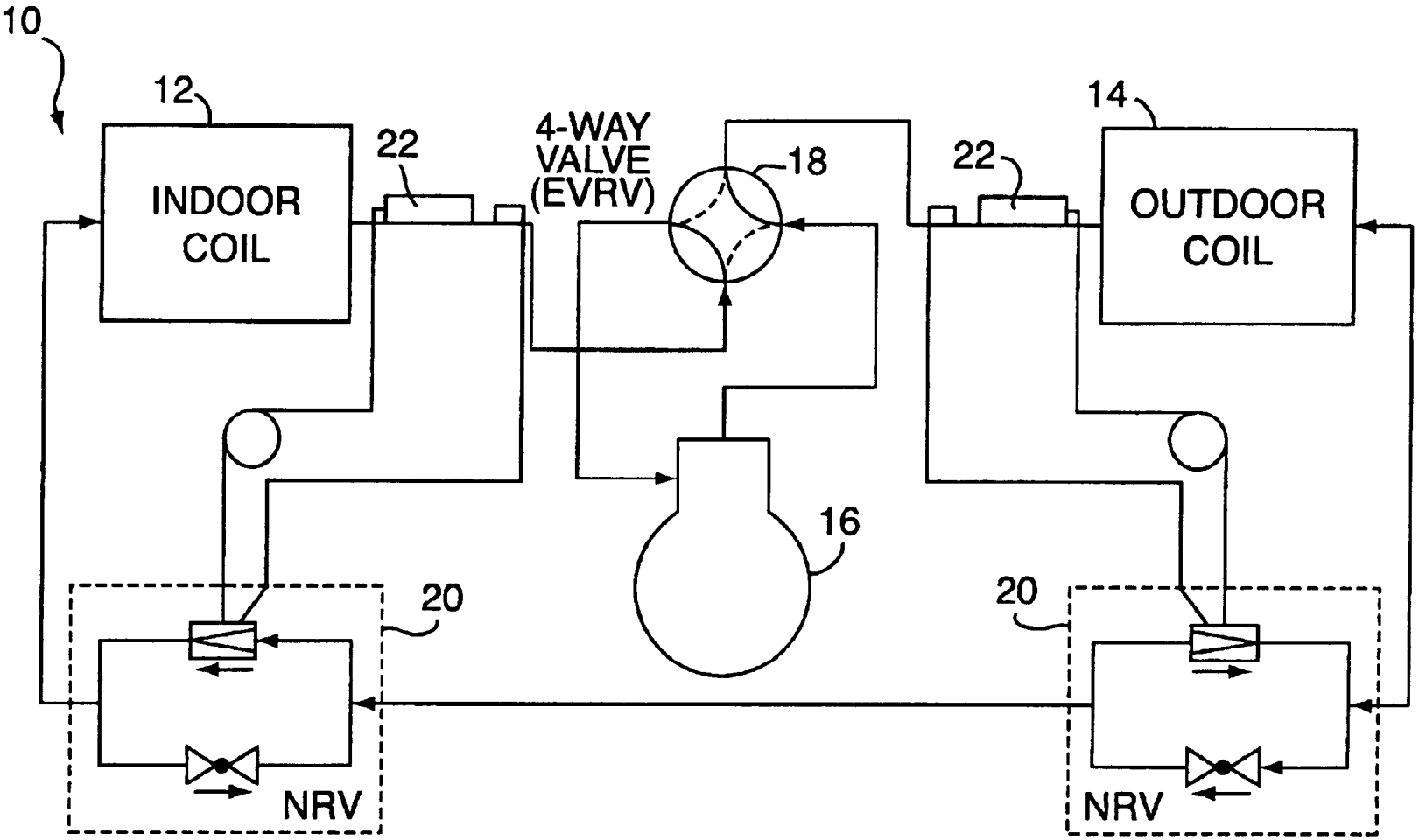
FIG. 1 schematically illustrates a typical reversible heat pump system employing reversible thermal expansion valves.
Figure 2:
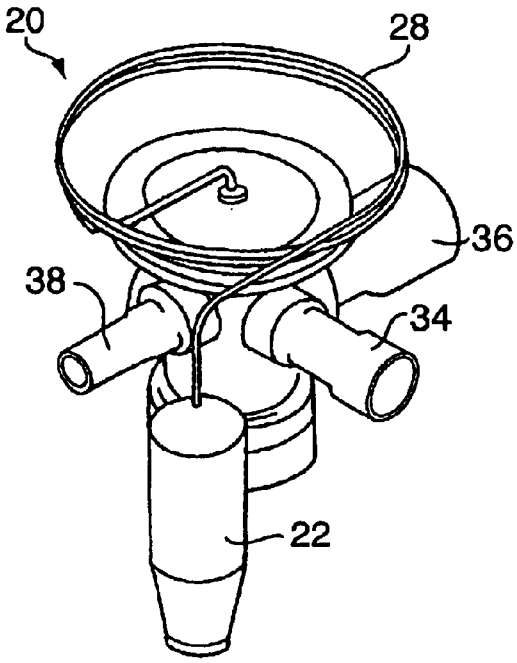
FIG. 2 is a perspective view of a thermal expansion valve having an inlet and outlet offset from one another.
Figure 3:
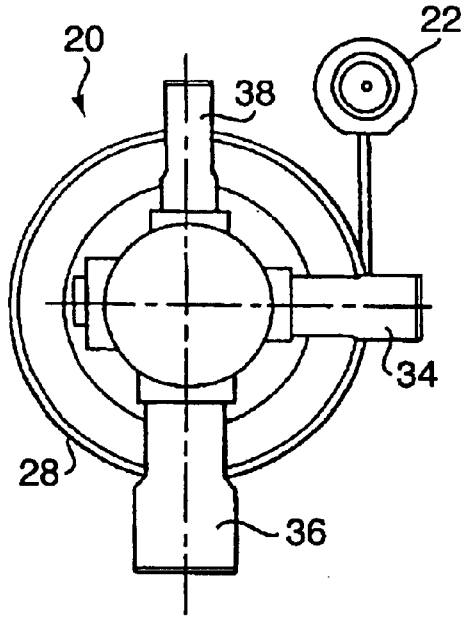
FIG. 3 is a bottom view of the thermal expansion valve of FIG. 2.
Figure 4:
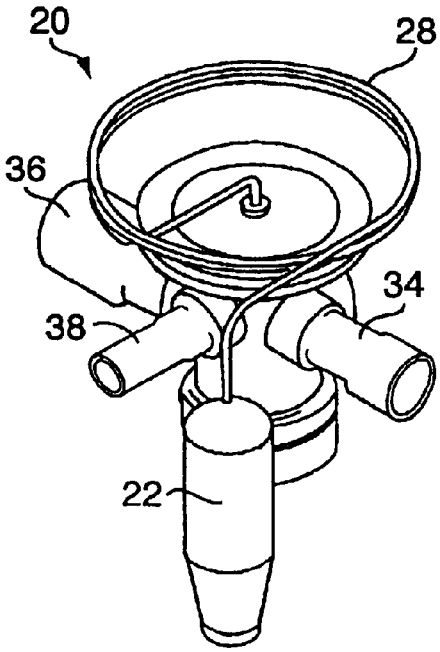
FIG. 4 is a perspective view of a thermal expansion valve having an inlet and outlet substantially aligned with one another.
Figure 5:
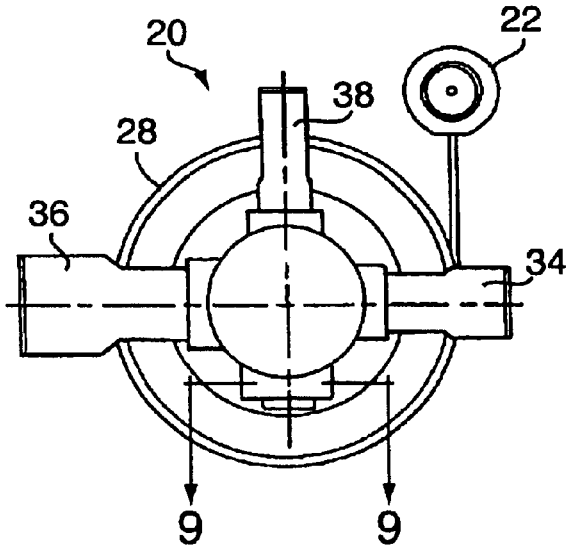
FIG. 5 is a bottom view of the thermal expansion valve of FIG. 4.

As shown in FIG. 1, a typical heat pump system generally designated by the reference number 10 includes two heat exchangers in the form of an indoor coil 12 and an outdoor coil 14. A compressor 16 is employed to provide refrigerant to a four way valve, the position of which determines which of the coils will operate as a condenser and which will operate as an evaporator in the heat pump system. Thermal expansion valves 20 forms part of the heat pump system 10. Each of the thermal expansion valves, 20 employs a temperature sensing bulb 22.

Figure 6:
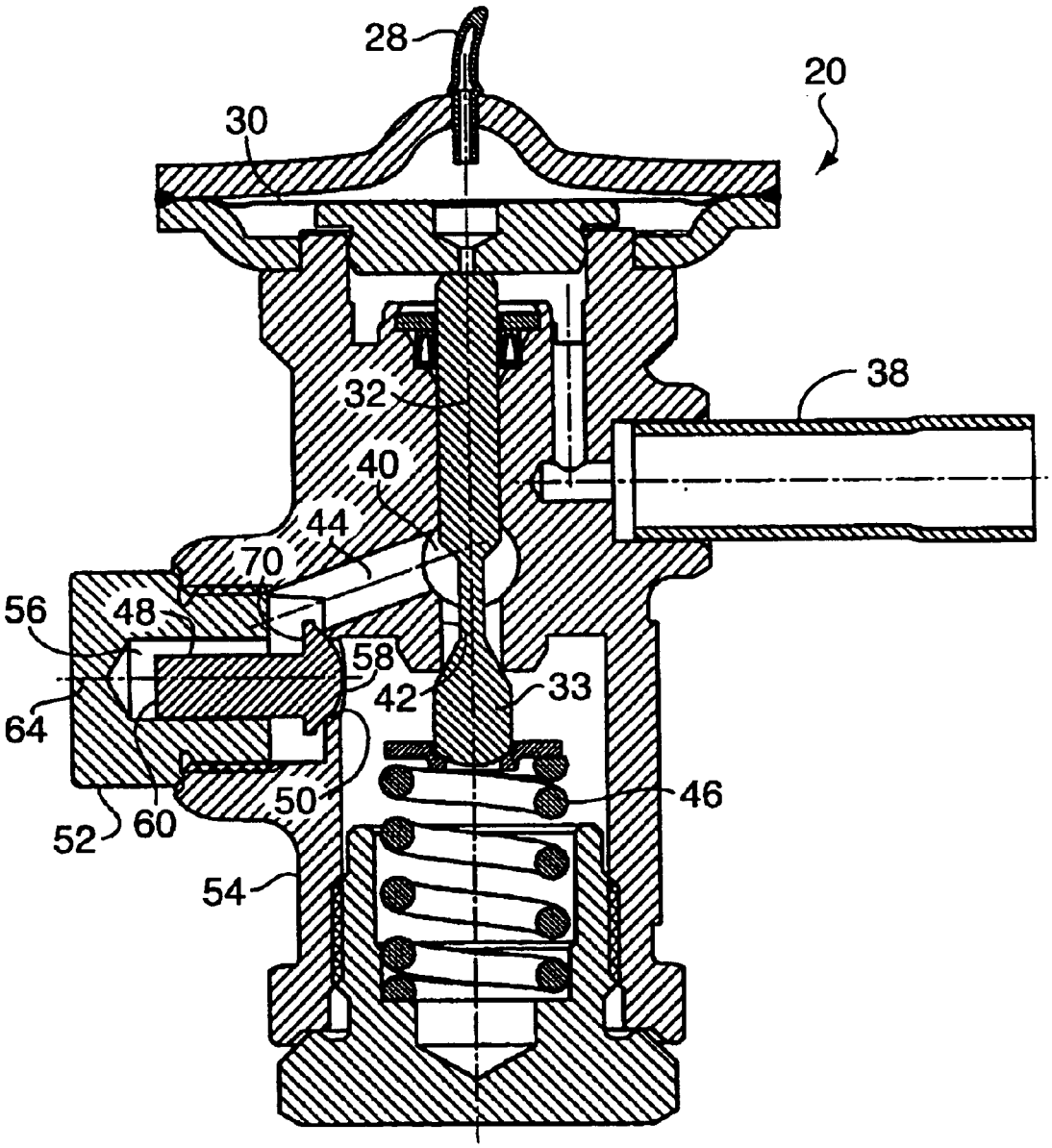
FIG. 6 is a cross-sectional view of the thermal expansion valve of FIGS. 4 and 5 taken along the line 6—6 in FIG. 5.

Referring to FIGS. 2–5, the temperature sensing bulb 22 is connected to the valve 20 via a conduit 28. As shown in FIG. 6, temperature sensed in the bulb 22 causes fluid therein to expand or contract which causes a concomitant increase or decrease in pressure. This pressure acts in a manner conventional to thermal expansion valves, on a membrane 30. The membrane 30 causes pressure to be exerted on an actuator 32, which, as will be explained herein below causes a closure portion 33 of the actuator to move between a closed position as shown in FIG. 6 and an open position.

Referring back to FIGS. 2–5, the thermal expansion valve 20 includes an inlet 34, an outlet 36 and a pressure equalization connection 38. As used herein, the terms "inlet" and "outlet" are relative terms in that when flow through the expansion valve is reversed the inlet and the outlet are reversed, as well. However, for operation with normal flow, the inlet and outlet, 34 and 36 respectively, are as shown in the Figures.

Figure 7:
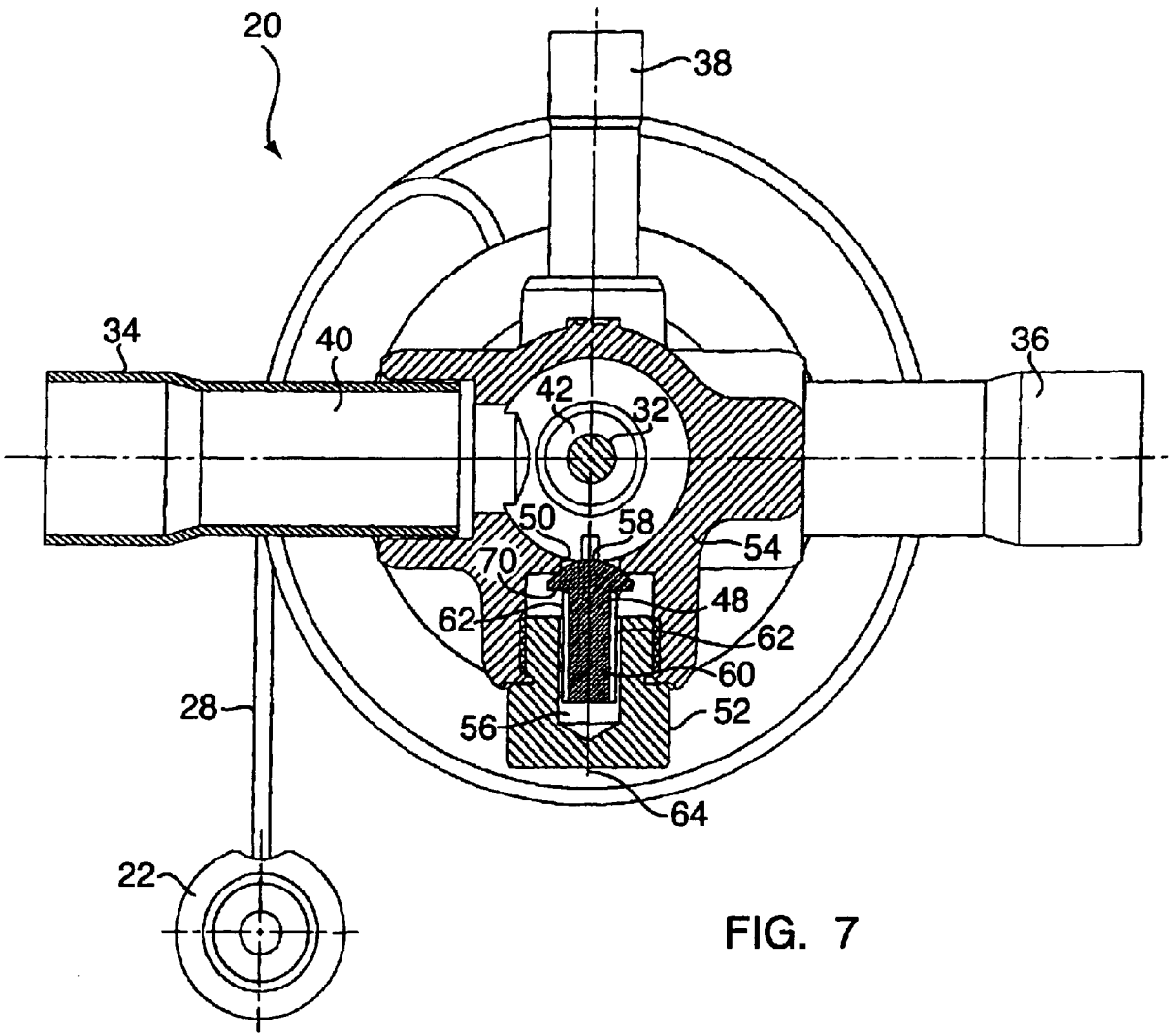
FIG. 7 is a partially cross-sectional plan view of the valve of FIGS. 4 and 5.
Figure 8:
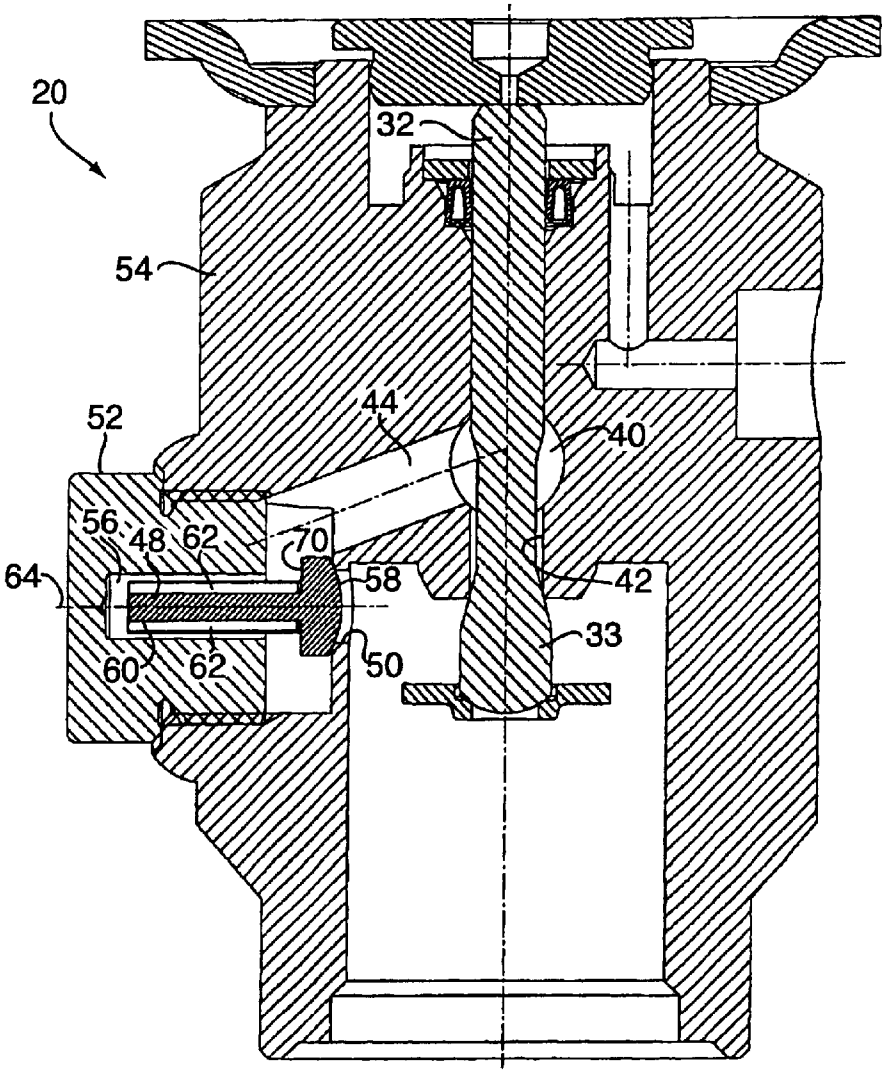
FIG. 8 is a partial cross-sectional view of the valve of FIGS. 4 and 5 illustrating the bypass flow path and the bypass closure and cover.

Referring to FIGS. 6–8 the thermal expansion valve 20 includes an inlet bore 40 in fluid communication with an expansion orifice 42 as well as with a bypass flow path 44. The expansion orifice 42 is closable via the above described closure portion 33, which is biased in a normally closed position by a spring 46. A bypass closure 48 is positioned in the bypass flow path 44 and is movable between a closed position, as shown in FIGS. 6 and 8, and an open position (not shown). In the closed position, the bypass closure 48 blocks an aperture 50 that, when the bypass closure is in the open position, is in fluid communication with the bypass flow path 44 and the outlet 36.

A bypass cover 52 is threadably mounted to the body 54 of the expansion valve 20 and defines a guide path in the form of a bore 56 extending partway through the bypass cover. The bypass closure 48 includes a head portion 58 that is engagable with the valve body 54 to block the aperture 50 when the bypass closure is in the closed position. An extension 60 projects outwardly from the head portion 58 of the bypass closure 48 and is slidably received within the guide path. During movement of the bypass closure 48 from the closed position to the open position the extension 60 moves within, and is constrained by the guide path 56. As will be explained in detail below, the bypass closure 48 is free floating within the valve body 54 and is maintained in the closed position or moved toward the open position via fluid pressure generated by refrigerant flowing from the inlet to the outlet, and from the outlet to the inlet respectively.

Figure 9:
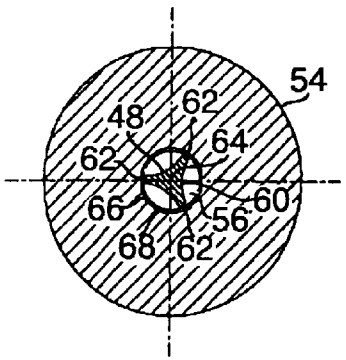
FIG. 9 is a cross-sectional view of the valve of FIG. 5, taken along lines 9—9 of FIG. 5.

As shown in FIG. 9, the extension portion 60 of the bypass closure 48 is comprised of three radially extending lobes 62 all emanating from an approximately central, longitudinal axis 64. The lobes 62 circumscribe a shape 66 that approximates the cross-sectional shape 68 of the guide path 56. The lobes 62 are approximately equally spaced and define gaps therebetween that allow refrigerant to escape therethrough during movement of the bypass closure 48. Thereby prevents the refrigerant from becoming trapped in the guide path 56. While three equally spaced lobes 62 have been shown and described, the present is not limited in this regard as any practical number of lobes, equally or unequally spaced, can be employed without departing from the broader aspects of the present invention.

In order to allow the expansion valve 20 of the present invention to be used in any orientation, it is preferable that the bypass closure 48 be formed from a material having a density substantially equivalent to the density of refrigerant in its liquid state. In this manner, the forces required to move the free floating bypass closure 48 will only have to be of a magnitude sufficient to overcome any friction present. The bypass closure is nearly completely surrounded by refrigerant and therefore the forces of gravity are neutralized by buoyancy. Therefore, the expansion valve can be oriented in any manner. Accordingly, common refrigerants which are usually designated by "R" numbers have the following densities at 25° C.; R-22 has a density of 1.247 g/cm$^3$, R-134A has a density of 1.210 g/cm$^3$, R-410A has a density of 1.062 g/cm$^3$, R-404A has a density of 1.048 g/cm$^3$, and R-407C has a density of 1.134 g/cm$^3$. Based on these values the preferred material is polyetheretherketone, a polymer commonly referred as PEEK. A suitable alternative is nylon, however, the present invention is not limited in this regard as any material having a suitable density and appropriate for use with refrigerant can be employed.

During normal operation of the expansion valve 20, as refrigerant flows from the inlet 34 toward the outlet 36 the closure portion 33 of the actuator 32 moves from the closed position toward the open position thereby allowing the refrigerant to pass through the expansion orifice 42. In addition, refrigerant flows into the bypass flow path 44 and exerts pressure on a rear surface 70 of the head portion 58 of the bypass closure thereby forcing the head portion against the aperture 50 preventing refrigerant from flowing therethrough.

When reverse flow conditions are realized, the closure portion 33 of the actuator 32 is in the closed position and refrigerant enters the outlet 36 and impinges against the head portion 58 of the bypass closure pushing the bypass closure toward the open position thereby allowing the refrigerant to flow through the aperture 50. Once passed the aperture 50, the refrigerant flows along the bypass flow path, and through the inlet 34.

While preferred embodiments have been shown and described, various modifications and substitutions may be made without departing from the spirit and scope of the invention. Accordingly, it is to be understood that the present invention has been described by way of example, and not by limitation.

What is claimed is:

1. An expansion valve comprising:

a valve body defining an inlet, an outlet, and an orifice in fluid communication with said inlet and said outlet;

a closure positioned in said valve body and adapted to close said orifice, said closure being movable between an open and closed position to allow or prevent fluid to flow through said orifice, from said inlet to said outlet;

said valve body defining a bypass flow path in fluid communication with said outlet and said inlet to allow fluid to flow from said outlet to said inlet;

a bypass closure positioned in the bypass flow path and movable between an open position and a closed position, so that when said closure is in said closed position, fluid flowing from said outlet toward said inlet causes said bypass closure to move toward said open position thereby allowing said fluid to flow in a reverse direction from said outlet to said inlet, and when said closure moves toward said open position, fluid pressure maintains said bypass closure in said closed position, thereby allowing said fluid to flow from said inlet to said outlet;

means defining a guide path, said bypass closure having an extension slidably positioned in said guide path; and said bypass closure being free floating with said extension being shaped to prevent fluid from becoming trapped in said guide path as said bypass closure moves between said open and closed positions.

2. An expansion valve as defined by claim 1, wherein said means defining a guide path includes a bypass cover coupled to said valve body, said guide path being defined at least in part by said bypass cover.

3. An expansion valve as defined by claim 2 wherein said bypass cover is threadably engagable with said valve body.

4. An expansion valve as defined by claim 1 wherein said portion of said bypass closure extending into said guide path has at least one radially extending lobe.

5. An expansion valve as defined by claim 4 wherein said portion has a plurality of radially extending lobes.

6. An expansion valve as defined by claim 5 wherein said plurality of radially spaced lobes are substantially equally spaced one from the other.

7. An expansion valve as defined by claim 2 wherein said guide path is defined by a bore extending at least partway through said bypass closure.

8. An expansion valve as defined by claim 1 wherein:

said fluid is refrigerant having a first density when in liquid form;

said bypass closure is formed from a material having a second density substantially equal to said first density.

9. An expansion valve as defined by claim 1 wherein said bypass closure is made from a polymeric material.

10. An expansion valve as defined by claim 9 wherein said polymeric material is PEEK.

11. An expansion valve as defined by claim 9 wherein said polymeric material is nylon.

12. An expansion valve comprising:

a valve body defining an inlet, an outlet, and an orifice in fluid communication with said inlet and said outlet;

a closure positioned in said valve body and movable between an open and closed position to allow or prevent fluid to flow through said orifice, from said inlet to said outlet;

said valve body defining a bypass flow path said bypass flow path being in fluid communication with said outlet and said inlet to allow fluid to flow from said outlet to said inlet;

a bypass closure positioned in said valve body and movable between an open position and a closed position, so that when said closure is in said closed position, fluid flowing from said outlet toward said inlet causes said bypass closure to move toward said open position thereby allowing said fluid to flow in a reverse direction from said outlet to said inlet, and when said closure moves toward said open position, fluid pressure maintains said bypass closure in said closed position, thereby allowing said fluid to flow from said inlet to said outlet; and wherein said fluid defines a first density, and said bypass closure is formed from a material defining a second density substantially equal to said first density.

13. An expansion valve as defined by claim 12 wherein:

said fluid is refrigerant and said bypass closure is formed from a polymeric material.

14. An expansion valve as defined by claim 13 wherein said polymeric material is PEEK.

15. An expansion valve as defined by claim 13 wherein said polymeric material is nylon.

* * * * *